US005179791A

United States Patent [19]

Lain

[11] Patent Number: 5,179,791

[45] Date of Patent: Jan. 19, 1993

[54] TORSIONAL SPRING INSOLE AND METHOD

[76] Inventor: Cheng K. Lain, 2092 Fourteenth Ave., San Francisco, Calif. 94116

[21] Appl. No.: 747,269

[22] Filed: Aug. 19, 1991

[51] Int. Cl.[5] ..... A43B 13/28; A43B 13/38; A43B 13/41; A43B 21/30

[52] U.S. Cl. ..... 36/27; 36/43; 36/76 C; 36/144

[58] Field of Search ..... 36/27, 43, 44, 76 C, 36/44, 144, 114

[56] References Cited

U.S. PATENT DOCUMENTS

| | | | |
|---|---|---|---|
| 1,352,865 | 9/1920 | Augestad | 36/43 |
| 2,203,157 | 6/1940 | Klaus | 36/43 |
| 3,393,460 | 7/1968 | Romen | 36/68 |
| 3,394,473 | 7/1968 | Romen | 36/2.5 |
| 3,550,597 | 12/1970 | Coplans | 128/585 |
| 4,231,169 | 11/1980 | Toyama et al. | 36/76 C |
| 4,232,457 | 11/1980 | Mosher | 36/44 |
| 4,268,980 | 5/1981 | Gudas | 36/43 |
| 4,291,428 | 9/1981 | Anzani | 36/44 |
| 4,305,212 | 12/1981 | Coomer | 36/80 |
| 4,338,734 | 7/1982 | Schwartz | 36/44 |
| 4,360,027 | 11/1982 | Friedlander et al. | 128/581 |
| 4,453,322 | 6/1984 | Marsh | 36/11.5 |
| 4,517,981 | 5/1985 | Santopietro et al. | 128/581 |
| 4,611,413 | 9/1986 | Brown | 36/44 |
| 4,654,984 | 4/1987 | Brown | 36/44 |
| 4,688,338 | 8/1987 | Brown | 36/44 |
| 4,702,255 | 10/1987 | Schenkl | 128/586 |
| 4,747,410 | 5/1988 | Cohen | 128/581 |
| 4,783,910 | 11/1988 | Boys, II et al. | 36/107 |
| 4,882,856 | 11/1989 | Glancy | 36/43 |
| 4,930,232 | 6/1990 | Engle | 36/44 |
| 4,949,476 | 8/1990 | Anderíe | 36/114 |
| 4,979,318 | 12/1990 | Cohen | 36/43 |

FOREIGN PATENT DOCUMENTS

| | | | |
|---|---|---|---|
| 3520731 | 12/1986 | Fed. Rep. of Germany | 36/43 |
| 3537850 | 5/1987 | Fed. Rep. of Germany | 36/43 |
| 8000781 | 5/1980 | World Int. Prop. O. | 36/27 |

*Primary Examiner*—Jimmy G. Foster
*Assistant Examiner*—M. D. Patterson
*Attorney, Agent, or Firm*—John S. Christopher

[57] ABSTRACT

A torsional spring insole for use in footwear having an elevated heel section for supporting the heel of a foot and an inner sole in communication with the elevated heel section for providing a torsional spring capability to the insole. A step-down region is provided for connecting the elevated heel section to the inner sole for flexing the inner sole in response to a pressure imbalance applied to the elevated heel section. The inner sole subsequently reflexes with the movement of the foot to position the elevated heel section to eliminate the pressure imbalance and to counteract pronation and supination in the foot.

The elevated heel section of the insole employs the heel counter structure of the shoe in which the insole is inserted to assist in counteracting pressure imbalances associated with pronation and supination. In an alternative embodiment, the elevated heel section of the insole includes a vertical heel counter for counteracting pressure imbalances due to pronation and supination.

19 Claims, 2 Drawing Sheets

TORSIONAL SPRING INSOLE AND METHOD

BACKGROUND OF THE INVENTION

1. Field of the Invention

The present invention relates to insoles for use in footwear. More specifically, the present invention relates to methods and apparatus for insoles of the type having a heel section elevated above and fused to an inner sole via a step-down region to provide energy savings and a torsional spring capability to counteract pronation.

While the present invention is described herein with reference to illustrative embodiments for particular applications, it should be understood that the invention is not limited thereto. Those having ordinary skill in the art and access to the teachings provided herein will recognize additional modifications, applications and embodiments within the scope thereof and additional fields in which the present invention would be of significant utility.

2. Description of the Related Art

In the field footwear manufacturing, comfort is a touchstone in design and construction of shoes. Inherent in this criteria are the requirements of adequate support and shock absorption. The standard of support and shock absorption is often measured by the insole of the shoe. In many cases, the insole of shoes are constructed of materials which provide limited support, shock absorption and stability to the foot. After wearing shoes constructed in this manner for several hours, the lower extremities become fatigued and prone to injury.

While walking or running, the body weight normally lands on the outer lateral side of the heel. As the foot continues to move forward, the body weight is redistributed to the inside of the heel and then forward to the ball of the foot. Common foot conditions that affects many people include pronation and supination. Pronation is generally defined as the turning of the foot inwardly placing pressure on the medial, inside portion of the foot. Supination is defined as the turning of the foot outwardly placing pressure on the medical outside portion of the foot. Placing the limb in either position substantially increases the probability of injury.

When the foot pronates or supinates during walking, the body weight lands severely to the inside or outside of the heel, respectively, placing a pressure imbalance on the heel of the shoe. Such a position tends to unbalance the movement and to place undue strain on the bones and tendons in the foot increasing the tendency to twist the ankle or sprain the foot. The body weight must then be redistributed about the heel and forward to the ball of the foot under these unbalanced conditions. Thus, it is difficult to walk or run and there is a constant threat of injury. Further, shoes become worn much faster because the shoe construction adjacent to the inside or outside heel is worn down by the constant pressure imbalance.

Much effort has been expended in the past to overcome the lack of support, shock absorption and stability in shoe construction. Various devices for improving shoe construction and for addressing the effects of pronation have been known for a number of years. By way of example, several forms of such devices can be found in U.S. Pat. Nos. 4,611,413, 4,654,984 & 4,688,338 to Brown, U.S. Pat. Nos. 3,393,460 & 3,394,473 to Romen, U.S. Pat. No. 3,550,597 to Coplans, U.S. Pat. No. 4,232,457 to Mosher, and U.S. Pat. No. 4,783,910 to Boys II et al. Many of the structures known in the past taught planar insoles.

The '984 patent to Brown, illustrates a rigid orthotic insert having a reinforcing structure for a heel comprising a plurality of layers, each layer having graphite fibers positioned parallel to one another and oriented along an axis skewed from the longitudinal axis of the insert. A unitary construction is disclosed. The '473 patent to Romen discloses a rigid insole for a ladies' shoe having a shape-retaining construction including an elastic counter. A strip of spring steel is included to strengthen the framework of the shoe.

The '597 patent to Coplans discloses a foot supporting and corrective device with front and rear main torsional sections inclined with respect to each other. The main torsional sections are connected by an intermediate longitudinal extending section of relative stiff spring properties. The main torsional sections are twisted around a longitudinal axis A for yieldably maintaining the main torsional sections in their angular positions. The device is designed to provide torsional action similar to the natural torsionlike action of the foot. The '457 patent to Mosher discloses an orthotic insert of a resilient molded flexible plastic support member having a spongy resilient heel post mounted on the lower surface of the heel region A. The insert is flexible enough to accommodate variations in individuals feet yet resists flex sufficiently to beneficially limit excessive foot pronation. The '910 patent to Boys II, et al. discloses a shoe with an anti-G-force heel capsule having a heel pad and a semi-rigid heel counter. The heel capsule interacts with an anti-torsion member and an energy efficient forefoot midsole section, thus providing a support and cushioning system that absorbs shock and prevents excessive pronation.

Hence, those concerned with the development and use of insoles in the footwear manufacturing industry have long recognized the need for an improved insole incorporating an elevated heel section which "steps-down" to an inner sole having a torsional spring capability to counteract pronation or supination in a foot and to provide support, shock absorption and stability in footwear utilizing said insole where the insole equally counteracts pronation or supination by forcing the shoe into the correct position, and utilizes bi-lateral construction to optimize shock absorption and subsequent energy release to assist in walking, employs graphite construction to ensure strength and flexibility and thermoplastic resins to ensure cushioned but wear resistant properties, and is suitable for use in numerous shoe constructions. Thus, there is a need in the art for an improvement in shock absorbing and anti-pronation/anti-supination insoles utilized in footwear construction. The present invention fulfills all of these needs.

SUMMARY OF THE INVENTION

The need in the art is addressed by the torsional spring insole of the present invention. The invention is a torsional spring insole for use in footwear having an elevated heel section for supporting the heel of a foot and an inner sole in communication with the elevated heel section for providing a torsional spring capability to the insole. A step-down region is provided for connecting the elevated heel section to the inner sole for flexing the inner sole in response to a pressure imbalance applied to the elevated heel section. The inner sole subsequently reflexes to position the elevated heel section to eliminate the pressure imbalance and to counteract pronation and supination in the foot.

In a first exemplary embodiment, the elevated heel section of the insole exhibits a gentle concave surface and employs the heel counter structure of the shoe in which the insole is inserted to assist in counteracting pressure imbalances associated with pronation and supination. In a second exemplary embodiment, the elevated heel section of the insole includes a vertical heel counter for counteracting pressure imbalances due to pronation and supination. The torsional spring insole can be incorporated as a permanent component of or can be removably inserted into the shoe. Thus, the invention provides a torsional spring insole which counteracts pronation and supination in and provides an energy boost to the foot.

DESCRIPTION OF THE INVENTION

Figure 1:
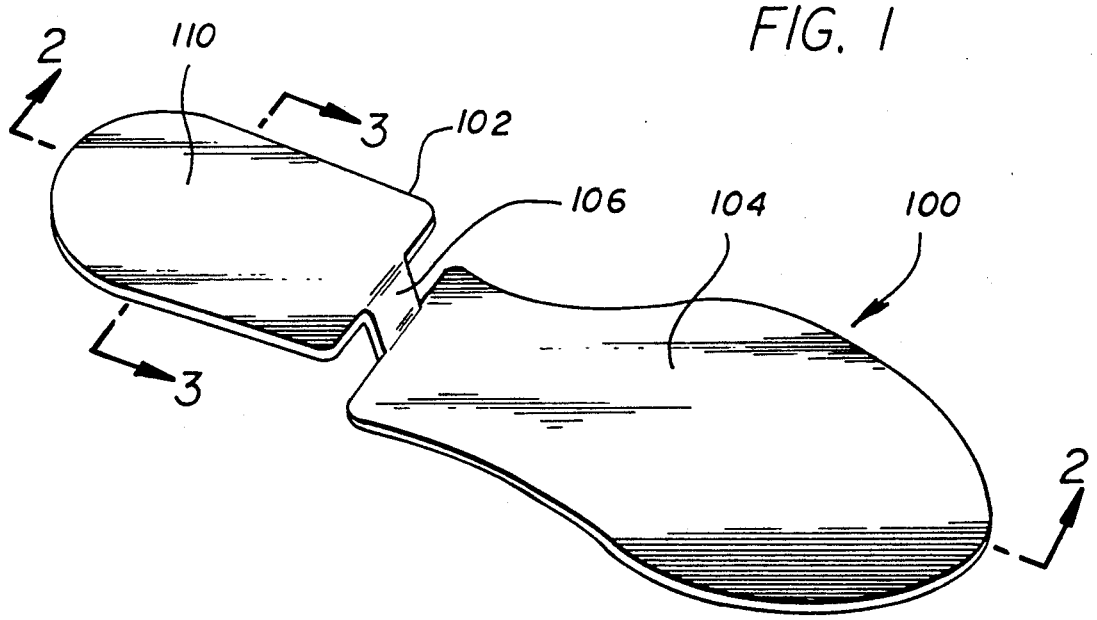
FIG. 1 is a simplified perspective view of an illustrative embodiment of a torsional spring insole embodying the novel features of the present invention.

As shown in the drawings for purposes of illustration, the invention is embodied in a torsional spring insole 100 having an elevated heel section 102 for supporting the heel of a foot, an inner sole 104 for providing a torsional spring capability to the insole 100 and a step-down region 106 for transferring rotational torque between the elevated heel section 102 and the inner sole 104.

When pronation or supination occurs, the body weight lands severely to the inside or outside of the heel of the foot, respectively, generating a pressure imbalance on the heel of the shoe. This position unbalances the movement of the foot and places undue strain on the bones and tendons in the foot. The tendency to twist the ankle or sprain the foot is increased. The body weight must then be redistributed about the heel and forward to the ball of the foot under these unbalanced conditions. Thus, it is difficult to walk or run and there is a constant threat of injury to the foot. Further, shoes wear out much faster because the shoe construction adjacent to the inside or outside heel is worn down by the constant pressure imbalance created by the pronated or supinated movements of the foot.

In accordance with the present invention, the step-down region 106 permits the elevated heel section 102 to flexibly cooperate with the inner sole 104 to minimize the effects of pronation and supination on the foot and to significantly increase support, shock absorption and stability in footwear utilizing the insole 100. Moreover, the torsional spring insole 100 decreases the probability of injury to the foot caused by pressure imbalances generated in the elevated heel section 102, equally counteracts pronation and supination forcing the shoe into the correct position, utilizes a bi-lateral construction to optimize shock absorption and to subsequently provide an energy lift to assist in walking and running, employs carbon graphite construction in the inner sole 104 to ensure strength and flexibility and thermoplastic resins throughout the insole 100 to ensure cushioned but wear resistant properties, and is suitable for use in numerous shoe constructions.

Figure 2:
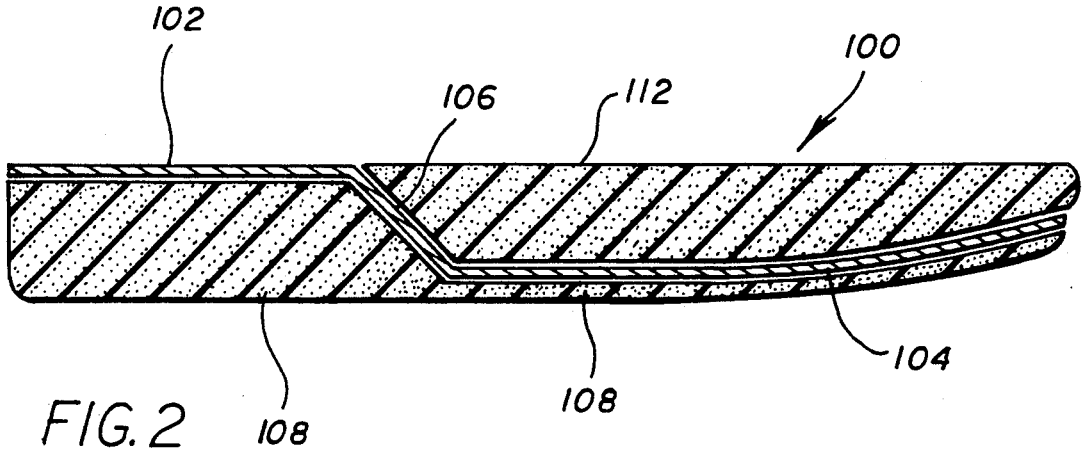
FIG. 2 is a detailed cross-sectional view of the torsional spring insole taken along the line 2—2 of FIG. 1 showing the outer sole, the filler material and the step-down region between the heel section and the inner sole.

The torsional spring insole 100 serves several major purposes which include shock absorption, anti-pronation and anti-supination support and energy conservation. Further, these purposes are accomplished whether the insole is removably inserted into footwear or is incorporated into the footwear as a permanent construction element. The insole can be utilized in several different types of shoe constructions for shock absorption and energy conservation due to the spring board effect exhibited by the step-down region 106 as shown in FIGS. 1 and 2. Further, the torsional spring response in the inner sole 104 resulting from a pressure imbalance applied to the elevated heel section 102 provides the anti-pronation and anti-supination features.

When employed in footwear, the insole 100 assists in correcting the pronation or supination experienced by the foot with a torsional spring effect which repositions the foot. Since the torsional spring effect is equivalent on both the left and right sides of the insole, the foot position will be corrected during pronation or subination. Thus, during ankle pronation when the body weight lands severely to the inside of the heel turning the foot inward or during ankle supination when the body weight lands severely to and on the outside of the heel turning the foot outward, the torsional spring effect of the insole 100 corrects the problem. This is accomplished by forcing the shoe in which the insole is inserted into the correct position. Further, since the foot is secured within the shoe, the foot is also forced into the correct position.

Figure 3:
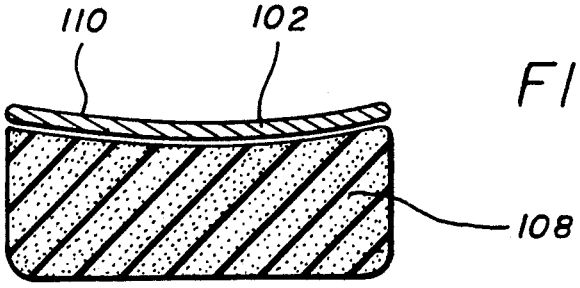
FIG. 3 is a cross-sectional view of the torsional spring insole taken along the line 3—3 of FIG. 1 showing the heel section and outer sole looking forward toward the step-down region.

As is shown in FIGS. 1 and 2, the elevated heel section 102 is connected to the inner sole 104 via the step-down region 106. The elevated heel section 102 in combination with an outer sole 108 cooperates with the inner sole 104 to support the body weight throught the foot as is shown in FIG. 2. The elevated heel section 102 can be comprised of, for example, a thermoplastic resin such as polyvinyl chloride (PVC) and is formed with a gentle concave surface 110 as shown in FIG. 3 for cupping the bottom of the foot. The concave surface 110 is utilized to assist in the transfer of a pressure imbalance to the inner sole 104 via the step-down region 106 during pronation or supination.

The outer sole 108, in addition to supporting the elevated heel section 102, includes a forward portion which underlies the inner sole 104 for supporting the body weight. The outer sole is cushioned for comfort but is very tough and wear resistant and can be comprised of, for example, PVC, polyurethane (PU) or ethylene vinyl acetate (EVA). Further, the outer sole 108 is cemented to the elevated heel section 102 and to the inner sole 104 for creating robust bonds therebetween. Positioned above the inner sole 104 is a solid filler material 112 which functions to position the bottom of the forefoot level with the elevated heel section 102 as is shown in FIG. 2. Thus, the filler material 112 is utilized to permit the bottom of the entire foot to rest at the same level. The filler material can be comprised of, for example, PVC, PU or EVA and is cemented to the top of the inner sole 104 for creating a robust bond therebetween.

The inner sole 104 in combination with the elevated heel section assists in supporting the weight of the body through the foot and provides the torsional spring effect to the insole 100. The inner sole must be very strong yet resilient and flexible to support the body weight and thus can be comprised of, for example, carbon graphite fibers. In particular, a graphite mold press can be employed to press form the shape of the inner sole 104. An example construction of the inner sole 104 can include a combination of carbon graphite fibers and PVC. Thereafter, the carbon graphite/PVC inner sole can be injection molded to the PVC elevated heel section 102 for forming the step-down region 106. This design results in a single unitary injected component as shown in FIG. 1. An alternative method to the injection molded process includes that of cementing the inner sole 104 to the elevated heel section 102 via an independently formed step-down region 106 for creating a strong, resilient and flexible bond therebetween.

The step-down region 106 is an extended portion for connecting the inner sole 104 to the elevated heel section 102 and is comprised of, for example, PVC. The step-down region is a major feature which permits the insole 100 to be utilized for several purposes including shock absorption, anti-pronation and anti-supination support, and energy conservation. As shown in FIG. 1, the step-down region causes the elevated heel section 102 and the inner sole 104 to assume a Z-shape as in a spring board. Thus, the step-down region is bi-level. The shock of the foot stepping down on the insole 100 is absorbed by the elevated heel section 102 and when the heel section absorbs the shock, the insole bends. The bending of the flexible Z-shaped insole 100 thus stores potential energy therein. As the body weight moves forward and is transferred to the inner sole 104, the potential energy stored in the insole is released providing an energy boost to the heel of the foot. Thus, in addition to shock absorption, the energy boost provided contributes to energy conservation by assisting a person utilizing the insole 100 in walking and running.

The step-down region 106 is also utilized in the anti-pronation and anti-supination features for transferring rotational torque from the elevated heel section 102 to the inner sole 104. During walking or running, either pronation or supination of the foot (e.g., generally, the ankle) can occur. During pronation, the foot is turned inward placing pressure on the medial, inside portion of the foot. Likewise during supination, the foot is turned outward placing pressure on the medial, outside portion of the foot. Either condition can result in great potential for injury. When using the insole 100 in, for example, a conventional shoe, the foot is cupped within the gentle concave surface 110 as shown in FIG. 3. Further, the rear of the foot is surrounded by a heel counter (not shown in FIGS. 1–3) which is integral to the shoe construction.

As the foot is improperly turned during pronation or supination, a pressure imbalance results. The pressure imbalance causes a force or rotational torque to be applied to the concave surface 110 and to the heel counter of the shoe. The body weight and the shoe construction hold the insole 100 in position. Thus, the force applied to the elevated heel section 102 and the heel counter caused by the pressure imbalance forces the insole including the heel section 102, the step-down region 106 and the inner sole 104 to bend or flex. A torsional spring moment is placed on the inner sole 104. Because the inner sole 104 includes a torsional spring characteristic, potential energy is stored within the step down region of the insole 100. As the body weight moves forward, the stored energy in the step-down region 106 is released causing the inner sole 104 to twist back or reflex back to the non-pronated or non-supinated position. This anti-pronation or anti-supination response occurs to counteract the pressure imbalance in the heel section 102.

An alternative embodiment of the torsional spring insole of the present invention having the general reference number 200 will now be disclosed. In this instance, the alternative embodiment of the torsional spring insole disclosed in FIGS. 4–6 also exhibits the step-down region similar to that of the preferred embodiment disclosed in FIGS. 1–3. Components of the insole 200 of FIGS. 4–6 which find substantial correspondence in structure and function to those parts of FIGS. 1–3 are designated with corresponding numbers of the two-hundred series.

Figure 4:
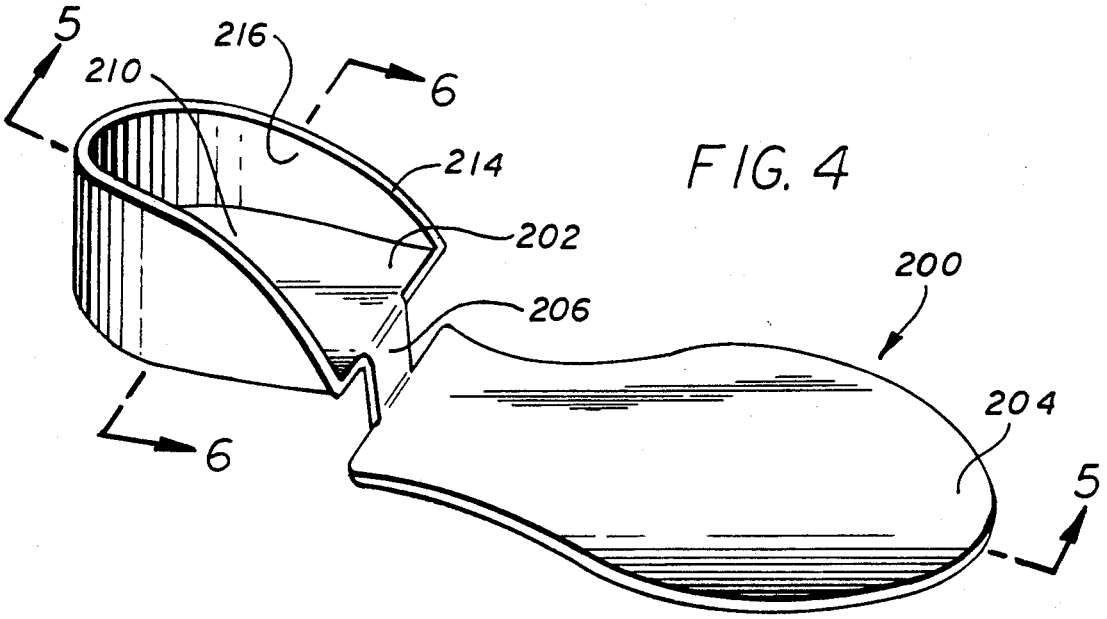
FIG. 4 is a simplified perspective view of an alternative embodiment of a torsional spring insole embodying the novel features of the present invention and illustrating a vertical heel counter attached to the heel section.
Figure 5:
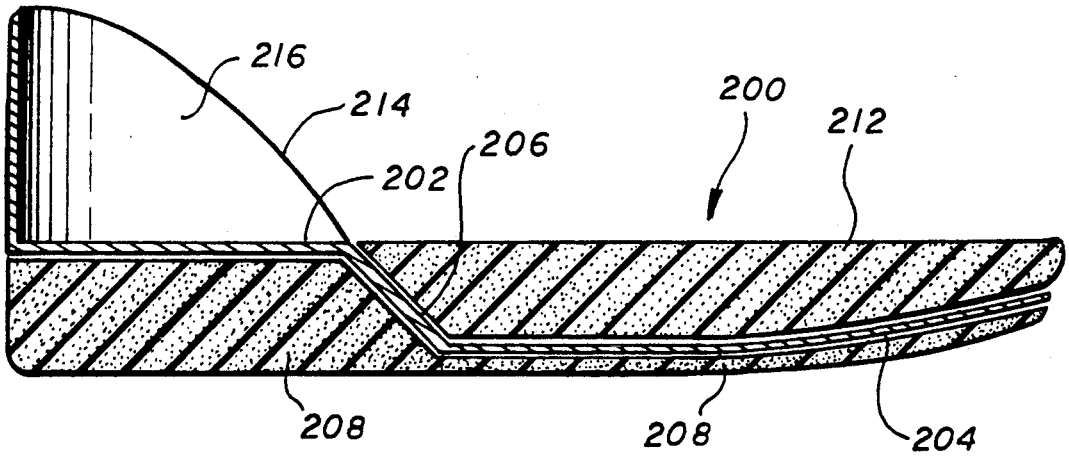
FIG. 5 is a detailed cross-sectional view of the torsional spring insole taken along the line 5—5 of FIG. 4 showing the outer sole, the filler material and the step-down region between the heel section having the vertical heel counter and the inner sole.
Figure 6:
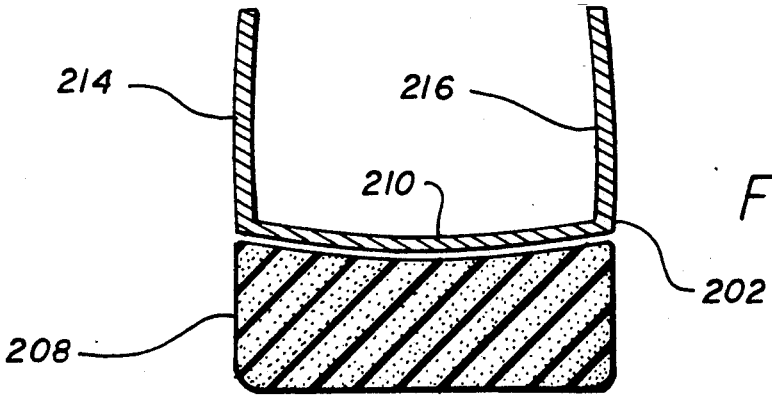
FIG. 6 is a cross-sectional view of the torsional spring insole taken along the line 6—6 of FIG. 4 showing the outer sole and the vertical heel counter attached to the heel section looking forward toward the step-down region.

The torsional spring insole 200 includes an elevated heel section 202, an inner sole 204, a step-down region 206, an outer sole 208, a concave surface 210 associated with the elevated heel section 202, and a filler material 212 as shown in FIGS. 4–6. Each of these components perform the same function in the same manner as described in the preferred embodiment of the torsional spring insole 100 shown in FIGS. 1–3.

Mounted vertically above the elevated heel section 202 is a heel counter 214 which is fashioned to surround the heel of the foot as is shown in FIGS. 4–6. The vertical heel counter 214 is arcuate in shape and is comprised of, for example, rigid PVC. The rigid PVC is smooth and can have a cushioned lining 216 along the inside of the counter 214 for contributing to foot comfort. In the insole 200, the inner sole 204 is formed in the graphite mold press (not shown) and thereafter injection molded to the elevated heel section 202 for forming the step-down region 206 as previously explained with regard to the insole 100.

The insole 200 is positioned within a conventional shoe (not shown) as previously explained. However, the vertical heel counter 214 is now employed to transfer a pressure imbalance from the elevated heel section 202 to the inner sole 204 via the step-down region 206. The built-in heel counter construction of the conventional shoe is no longer utilized to transfer the pressure imbalance to the inner sole 204. However, by employing the insole 200, the foot is surrounded by the vertical heel counter 214 and by the heel counter associated by the shoe construction.

As in the preferred embodiment, when the foot is improperly turned during pronation or supination, a pressure imbalance results. The pressure imbalance causes a force or rotational torque to be applied to the concave surface 210 and to the vertical heel counter 214. The body weight and the shoe construction hold the insole 200 in position. Thus, the force applied to the elevated heel section 202 and the vertical heel counter 214 caused by the pressure imbalance forces the insole 200 including the elevated heel section 202, the step-down region 206 and the inner sole 204 to bend or flex. A torsional spring moment is placed on the inner sole 204. Because the inner sole 204 includes a torsional spring characteristic, potential energy is stored within the step-down region 206 of the insole 200. As the body weight moves forward, the stored energy in the step-down region 206 is released causing the inner sole 204 to twist back or reflex back to the non-pronated or non-supinated position. This anti-pronation or anti-supination response occurs to counteract the pressure imbalance in the heel section 202. Further, the shock absorbing and energy conservation features disclosed in the insole 100 are also incorporated into the construction of insole 200.

Thus, the present invention has been described herein with reference to a particular embodiment for a particular application. Those having ordinary skill in the art and access to the present teachings will recognize additional modifications, applications and embodiments within the scope thereof.

It is therefore intended by the appended claims to cover any and all such modifications, applications and embodiments within the scope of the present invention.

Accordingly,

What is claimed is:

1. A torsional spring insole for use in footwear comprising, in combination:

elevated means for supporting the heel of a foot;

means in communication with said elevated heel supporting means for providing a torsional spring capability to an insole; and energy storing step-down means for connecting said elevated heel supporting means to said torsional spring means for flexing said torsional spring means in response to a pressure imbalance applied to said elevated heel supporting means, said torsional spring means subsequently reflexing to position said elevated heel supporting means to counteract said pressure imbalance.

2. The torsional spring insole of claim 1 wherein said elevated supporting means comprises an outer sole.

3. The torsional spring insole of claim 1 wherein said elevated supporting means is comprised of a wear resistant, cushioned material comprising a thermoplastic resin.

4. The torsional spring insole of claim 1 further including a filler material for supporting said foot.

5. The torsional spring insole of claim 1 wherein said means for providing a torsional spring capability to said insole comprises an inner sole.

6. The torsional spring insole of claim 1 wherein said means for providing a torsional spring capability to said insole comprises a combination of carbon graphite fibers and a thermoplastic resin.

7. The torsional spring insole of claim 1 wherein said energy storing step-down connecting means is comprised of a thermoplastic resin.

8. A torsional spring insole for use in footwear comprising, in combination:

elevated means for supporting the heel of a foot;

an inner sole in communication with said elevated heel supporting means for providing a torsional spring capability to an insole; and an energy storing step-down region for connecting said elevated heel supporting means to said inner sole for flexing said inner sole in response to a pressure imbalance applied to said elevated heel supporting means, said inner sole subsequently reflexing to position said elevated heel supporting means to counteract said pressure.

9. The torsional spring insole of claim 8 wherein said energy storing step-down region comprises a thermoplastic resin having spring properties whereupon the application of a downward force to said inner sole causes said elevated heel supporting means to spring upward for applying an energy boost to the heel of said foot.

10. The torsional spring insole of claim 8 wherein said elevated supporting means comprises an outer sole.

11. The torsional spring insole of claim 8 further including a filler material for supporting said foot.

12. A torsional spring insole for use in footwear comprising, in combination:

elevated means for supporting the heel of a foot;

means for surrounding the heel of said foot, said surrounding means extending above said elevated heel supporting means;

means in communication with said elevated heel supporting means for providing a torsional spring capability to an insole; and energy storing step-down means for connecting said elevated heel supporting means to said torsional spring means for flexing said torsional spring means in response to a pressure imbalance applied to said elevated heel supporting means, said torsional spring means subsequently reflexing to position said elevated heel supporting means to counteract said pressure imbalance.

13. The torsional spring insole of claim 12 wherein said surrounding means comprises a vertical heel counter.

14. The torsional spring insole of claim 12 wherein said surrounding means comprises a thermoplastic resin.

15. A torsional spring insole for use in footwear comprising, in combination:

elevated means for supporting the heel of a foot;

a vertical heel counter for surrounding the heel of said foot, said vertical heel counter extending above said elevated heel supporting means;

an inner sole in communication with said elevated heel supporting means for providing a torsional spring capability to an insole; and an energy storing step-down region for connecting said elevated heel supporting means to said inner sole for flexing said inner sole in response to a pressure imbalance applied to said elevated heel supporting means, said inner sole subsequently reflexing to position said elevated heel supporting means to counteract said pressure.

16. A method of constructing a torsional spring insole for use in footwear, said method comprising the steps of:

providing an elevated support for the heel of a foot;

incorporating an inner sole in communication with said elevated support for providing a torsional spring capability to an insole; and connecting said elevated support to said inner sole in an energy storing step-down configuration for transferring a pressure imbalance created within said elevated support to said inner sole and for flexing said inner sole in response to said pressure imbalance, said inner sole reflexing with said torsional spring capability to position said elevated support to counteract said pressure imbalance.

17. The method of constructing the torsional spring insole of claim 16 further including the step of surrounding the heel of said foot with a vertical heel counter extending above said elevated support.

18. The method of constructing the torsional spring insole of claim 16 further including the step of forming said inner sole with a combination of carbon graphite fibers and a thermoplastic resin for providing strength and flexibility.

19. The method of constructing the torsional spring insole of claim 16 further including the step of forming the connection between said elevated support and said inner sole with a flexible thermoplastic resin so that upon applying a downward force to said inner sole, said elevated support springs upward to provide an energy boost to the heel of said foot.

* * * * *